US006968800B1

(12) United States Patent
Becht

(10) Patent No.: US 6,968,800 B1
(45) **Date of Patent: *Nov. 29, 2005**

(54) APPLIED SUN SHADE TO A LAUNCHED BOAT

(76) Inventor: John J. Becht, 1515 Youngs Ave., Southhold, NY (US) 11971

( * ) Notice: Subject to any disclaimer, the term of this patent is extended or adjusted under 35 U.S.C. 154(b) by 0 days.

This patent is subject to a terminal disclaimer.

(21) Appl. No.: 10/931,633

(22) Filed: Sep. 2, 2004

(51) Int. Cl.[7] ..... B63B 17/00
(52) U.S. Cl. ..... 114/361; 280/414.2
(58) Field of Search ..... 114/242, 344, 361; 135/88.01; 280/414.1, 414.2

(56) References Cited

U.S. PATENT DOCUMENTS 2,453,422 A * 11/1948 Ellsworth ..... 114/361
2,847,019 A * 8/1958 Ogle, Sr. ..... 114/361
3,659,868 A * 5/1972 Tucker ..... 114/344
3,697,096 A * 10/1972 Hadley ..... 114/344
3,831,211 A * 8/1974 Bustamante ..... 114/344
3,896,832 A * 7/1975 Montoya ..... 114/361
4,300,252 A * 11/1981 Montooth ..... 280/414.2
5,425,326 A * 6/1995 Tibbedeaux ..... 114/344
5,441,066 A * 8/1995 Harris ..... 135/88.01
RE37,855 E 9/2002 Becht

* cited by examiner

*Primary Examiner*—Lars A. Olson
(74) *Attorney, Agent, or Firm*—Myron Amer P.C.

(57) ABSTRACT

In a boat having a rear transom of a type (1) transported on land on attached wheels in depending relation from brackets on the transom and (2) launched to provide a floating condition in a lake and (3) removing the wheels from the floating boat preparatory to making accessible the transom brackets and, using the transom brackets, to apply to a sun shade to the boat.

1 Claim, 3 Drawing Sheets

APPLIED SUN SHADE TO A LAUNCHED BOAT

The present invention relates generally to improvements in the use of lightweight boats at recreational sites, such as lakefronts, the improvements, more particularly residing in contributing to the enjoyment of the boating experience of the launched boat.

EXAMPLES OF THE PRIOR ART

After transportation of a skiff or lightweight boat to a lakefront on a van or the like, the boat preparatory to being launched is typically mounted on wheels means for the final distance to be traveled. Such wheel means already known and used for this purpose are described and illustrated in U.S. Pat. No. 4,588,203 for "Retractable Wheel Strut Assembly" issued to Milan B. Anderson on May 13, 1986, U.S. Pat. No. 4,127,281 for "Boat Roller" issued to Roy A. Ferguson on Nov. 28, 1978, and U.S. Pat. No. 3,831,211 for "Lightweight Boat Moving Device" issued to Sebastian R. Bustamente on Aug. 27,1 1974.

Once afloat however, the wheels serve no useful purpose and are thus removed. But what cannot be removed are the structural components that connect the wheels to the boat, usually to the transom, and these components thus remain without serving any useful purpose according to present practice.

Broadly, it is an object of the present invention to overcome the foregoing and other shortcomings of the prior art.

More particularly, it is an object of the present invention to use the wheel-connecting components made accessible upon the removal of the wheels therefrom, to serve a significant useful purpose for the boat in its launched condition, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Transporting the Boat

The drawings illustrate a known lightweight boat 10 of a type typically maintained at a site of storage, such as the user's garage, and transported to a site of use, such as a parking lot or like area within walking distance to a lake or other similar body of water in which the boat 10 is desired to be placed preparatory to use. The transport of choice from one site to the other is a van 12, the boat being located in its interior 14 or, alternatively on the van roof 16, but in either case placed, at the site of use, in the condition illustrated in FIG. 1.

Figure 1:
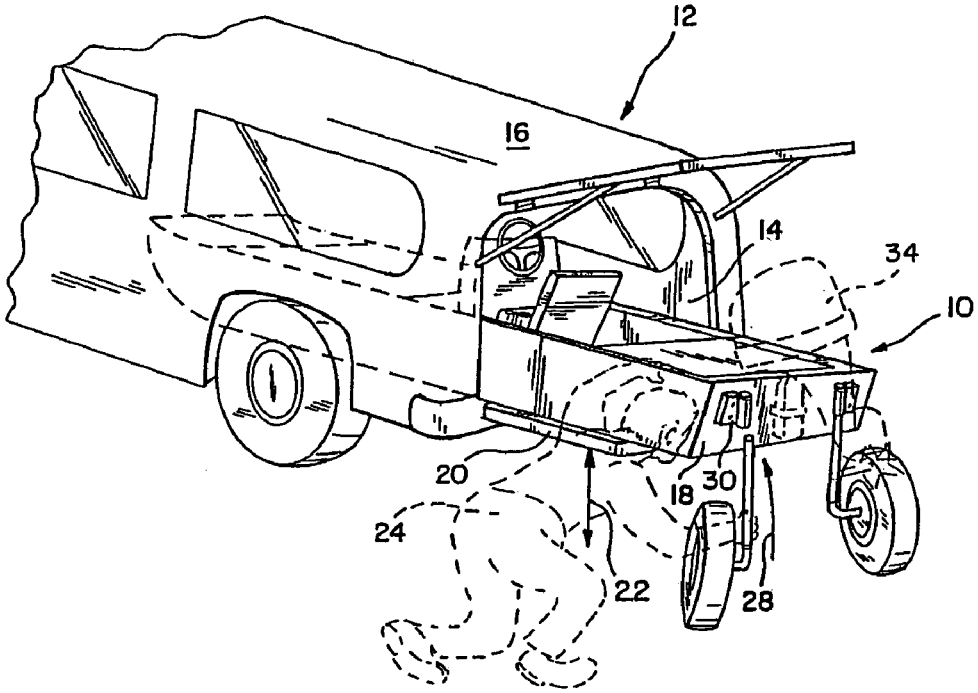
FIG. 1 is a perspective view of a van-transported boat illustrating preliminary preparation of the use of the boat according to the within inventive method.
Figure 2:
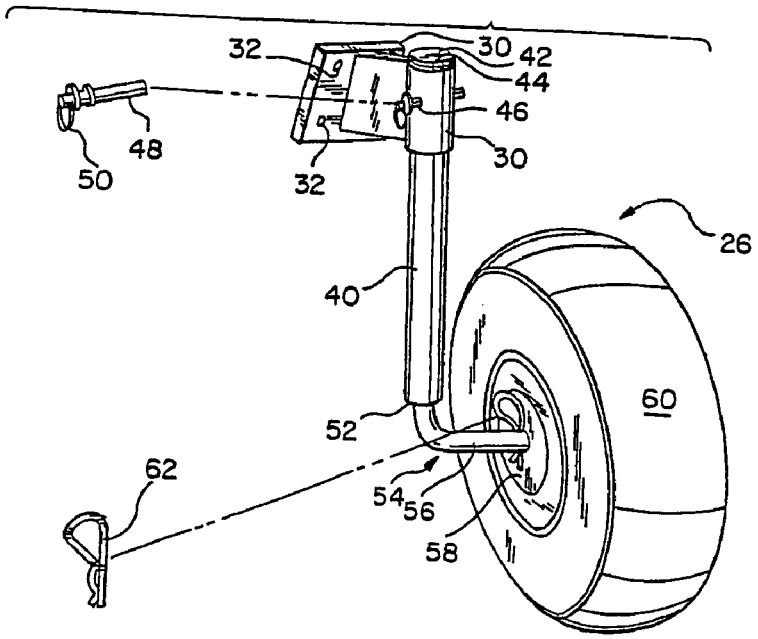
FIG. 2 is an exploded view of the wheel means selected to facilitate the boat preparation method.

The FIG. 1 boat condition contributes to the boat-preparation method hereof in that the boat transom 18 overhangs the van tailgate 20 and provides a working clearance 22 beneath the transom 18 in which the user 24 can readily insert a pair of left and right identical wheel means, generally designated 26 in FIG. 2, which wheel means 26 is selected to be attached, for the temporary purposes intended, in an upward or ascending movement 28 provided by the working clearance 22 into a cooperating left and right cylindrical bracket 30, each appropriately bolted, as at 32, to the transom 18 on opposite sides of the boat outboard motor 34, which motor is attached in a known manner at any appropriate time during the preparation of the boat at the option of the user 24.

Launching the Boat

Figure 3:
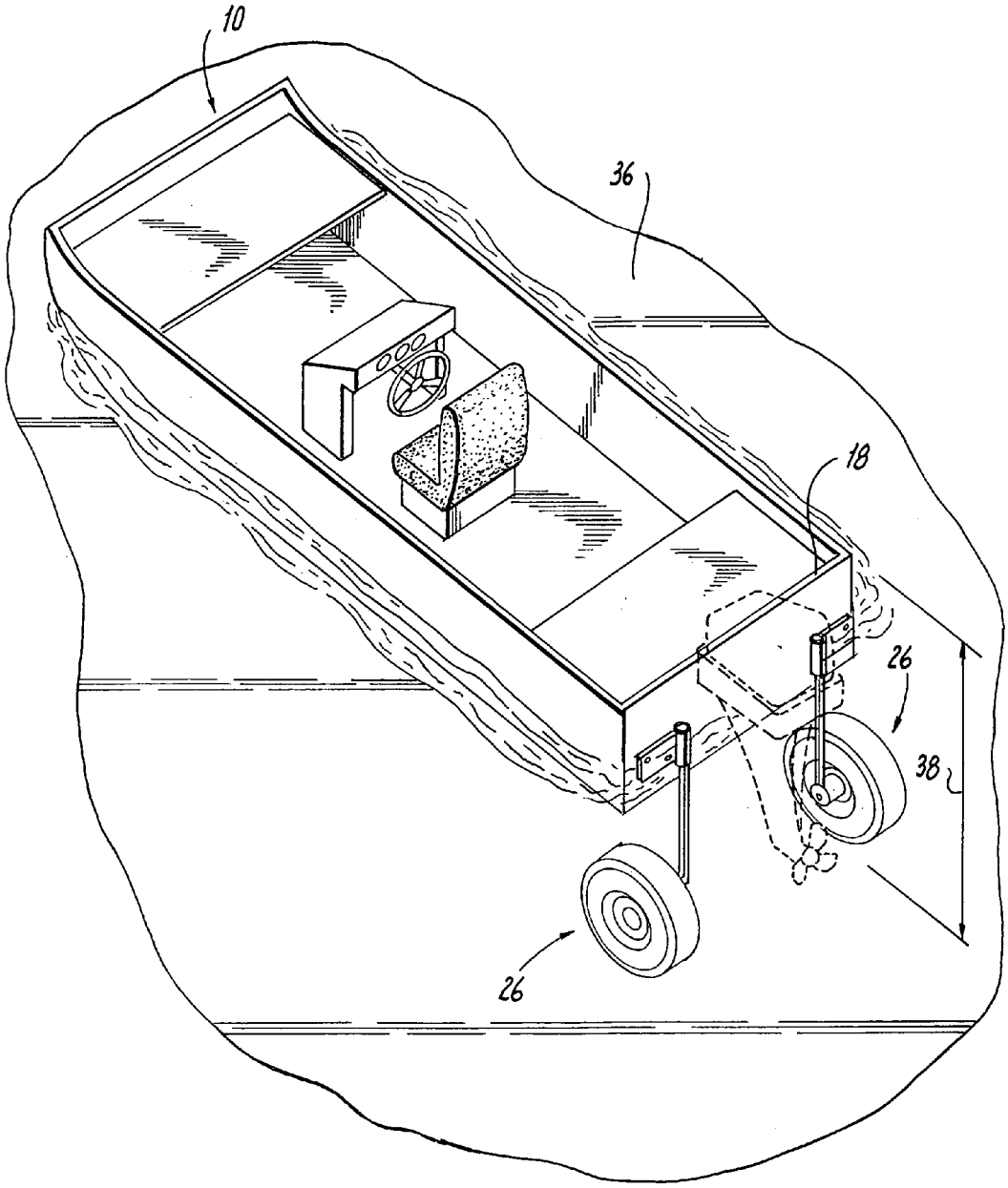
FIG. 3 is a view similar in perspective to FIG. 1 and illustrating the boat in a completed condition for use.

As shown in FIG. 3, the boat 10 with attached wheel means 26, which will be understood to have permitted the boat to be wheeled, much like a wheel barrow, from a lake-adjacent area to the lake 36 and placed in the boat-floating condition illustrated in FIG. 3. The FIG. 3 boat condition like that of FIG. 1 also contributes to the boat preparation method hereof in that the boat 10 floats at a depth 38 selected to provide working clearance beneath the transom 18 to permit the user to reach rearwardly over the transom 18 and unattach the wheel means 26 in a descending movement, duplicating but in reverse, the attaching movement 28.

Removing the Wheels

Shown in FIG. 2, to which reference should now be made, is a preferred embodiment of the identical left and right wheel means 26 selected to facilitate the boat-preparation method hereof in which attachment and detachment thereof in the working clearances of FIGS. 1 and 2 is readily achieved. To this end, each wheel means 26 consists of a rod 40 having an upper end 42 sized and shaped to be received in projected relation within a rod-receiving opening 44 of a cooperating cylindrical bracket 30 bolted on the transom 18. The inserted rod upper end 42 and each bracket 30 will be understood to have aligned bores 46 through which a pin 48 with a finger grip 50 is inserted to hold the wheel means 26 in attached relation to the transom 18 and conveniently griped by the grip 50 withdrawn in the detaching of wheel means 26 after the boat 10 is launched as shown in FIG. 3.

Rod 40 at its bottom end 52 is, in an appropriate manner, provided with a swivel extension 54 having a horizontally oriented axle 56 that is sized to be projected through a hub 58 of a wheel 60 of the wheel means 26 and pinned on an outboard side (not shown in FIG. 2), the wheel being held in place so as to be journalled for rotation on the axle 56 between an inboard pin 62 and the referred to outboard pin. For convenient storage, the wheels 60 can be detached by removal of the pins 62.

Applying the Sun Shade

Figure 4:
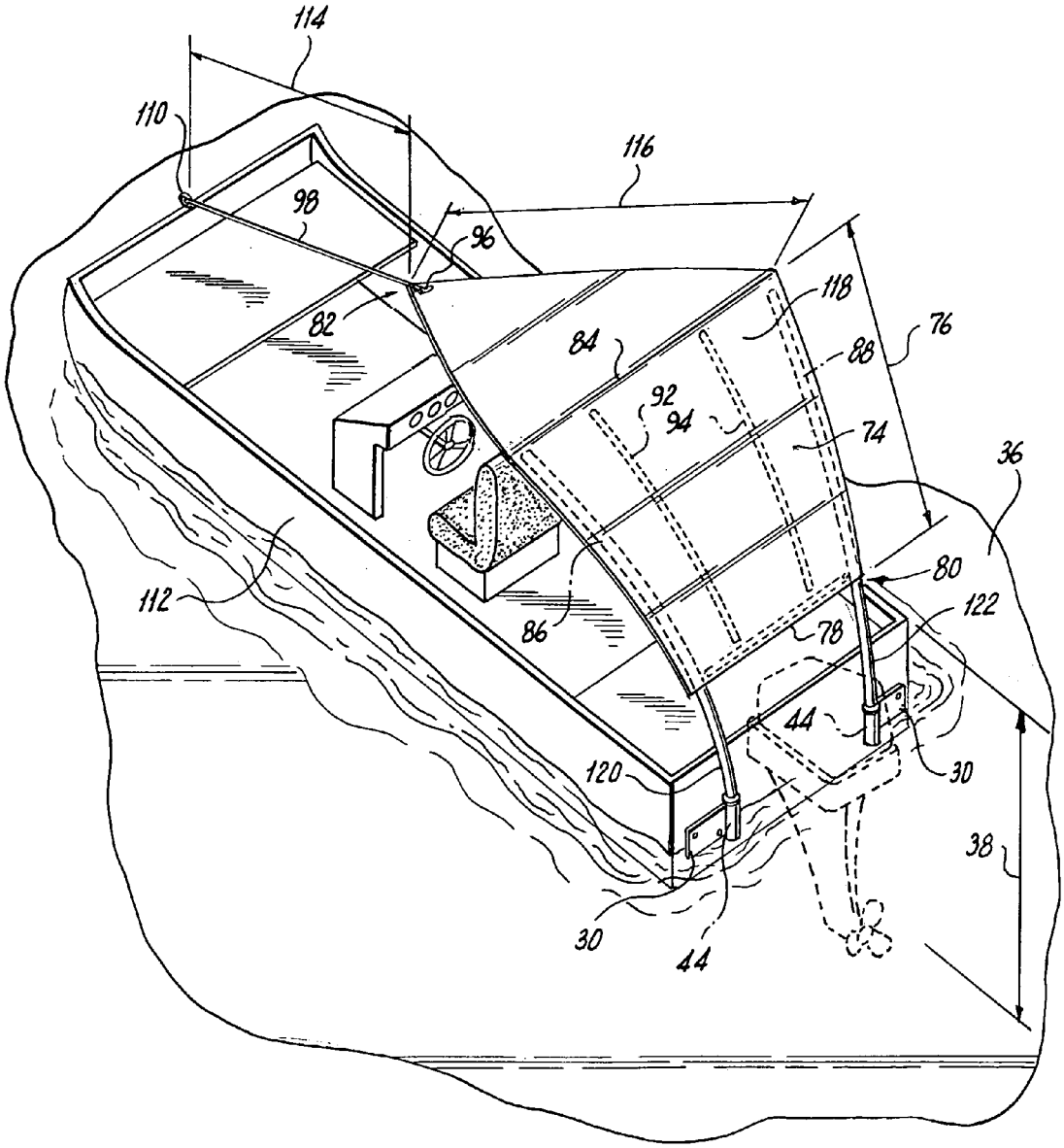
FIG. 4 is a view similar to FIG. 3 and illustrating, in accordance with the present invention the application to the boat of a sun shade.

Shown in FIG. 4 is the transported and launched boat 10, the utility of which has been additionally supplemented by the application to the boat 10 of a sun shade, generally designated 64, an application that is enhanced by the accessibility of the transom brackets 30. For the sun shade application, there is thus a cooperating pair of left and right spaced apart brackets 30 mounted on the transom, the respective surface of each of which bounds previously noted compartments or openings 44, now left unoccupied by the removal of each wheel 60 and connecting components, as previously described, to the transom 18.

In a preferred embodiment, the sun shade 64 is triangular in shape of fabric construction material 74 having at opposite ends of an expanse 76 thereof, a rear edge 78 consisting of a wood strut disposed in a fabric hem at a location coinciding with the base of the triangle, as at 80, and a front reference point 82 serving a connecting function subsequently to be described coinciding with an apex of the triangular shape.

In between the base 80 and front 82, and disposed partway lengthwise of the expanse 76 to a seam 84 are a plurality, preferably four in number, of a spaced apart flexuring struts of fiberglass, each approximately two inches wide, and each disposed in a hem, one such first strut located along an edge, as at 86, a second strut 88 located along an opposite sun shade edge, and two remaining third and fourth struts 92 and 94, located inwardly adjacent the side struts 88 and 90.

Completing the sun shade 64 is an eyelet 96, to which a length-adjustable tether cord 98 is connected to extend to, and be connected to an eyelet 110 on the bow 112, the length 114 of the cord 98 being selected to urge the fiberglass struts 86, 88, 94, and 92 into slightly curved configurations, as illustrated, to both cause the shade to be cast over the occupants of the boat and also to induce an urgency in the fiberglass struts to hold in a taut condition the tether cord 98 and a triangular front panel 116 of the strut-embodied rear panel 118 of the sun shade 64.

In the application of, or set-up of the sun shade 64, use is made of a left and a right male connector 120 and 122 appropriately connected to extend in depending relation from the rear edge 78, and each projected into, and held in place in a cooperating bracket compartments 40.

While the boat sun shade herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements in a method of preparing a boat for boating service, said boat being of a type having a bow and a stern and characterized by a nominal weight contributing to the transport of said boat from a site of storage to a site of use adjacent a body of water into which said boat provides said boating service, said method comprising the steps of A. attaching to said stern in spaced-apart relation a pair of cylindrical connecting members bounding a circular rod-receiving opening and each having opposite pin-receiving openings in horizontal alignment with each other, B. constructing for transport with said boat a pair of wheel means each comprised of a rod of a selected vertical size when used in a vertical orientation having a horizontally oriented axle attached to the bottom end of said rod and having journalled for rotation on said axle a wheel, said axle being projected through a hub of said wheel and pinned using an inboard pin means to hold said wheel in place and having a pin-receiving through bore adjacent an upper end of said rod, C. transporting in a condition supported from below said boat on a vehicle from said site of storage to said site of use, D. moving said boat stern in an overhanging relation to said vehicle to establish beneath said stern-attached cylindrical connecting members a working clearance exceeding that of said vertical size of said rod of said wheel means, E. moving said rods in said working clearance so as to cause an interengagement of said rod upper ends within said cylindrical connecting members and an alignment of said pin-receiving respective connecting members openings and upper end rod through bore, F. attaching said wheel means to said overhanging boat stern using outboard pin means seated in said pin-receiving respective connecting members openings and upper end rod through bore, G. transporting manually said boat with said attached wheel means into said adjacent body of water to a level exceeding said vertical size of said rod wheel means, H. detaching said wheel means from said boat by withdrawing said pin mean and urging said rods in descending movement clear of said cylindrical connecting members, I. attaching to said vacated cylindrical connecting members a sun shade means having:

(1) a triangular shaped cover of fabric construction material having at opposite ends of an expanse thereof a rear edge coinciding with a base of said triangular shape and a front point coinciding with an apex of said triangular shape;

(2) a male connector for each cylindrical connecting member extending from said cover rear edge; and (3) operative conditions for said male connectors disposed in projected relation into a cooperating said cylindrical connecting member surface-bounding compartment;

J. using a connector attached at one end in extending relation from said triangular shape front point;

K. having an operative condition of said front point connector attached to a bow of said boat; and L. flexuring cover-supporting means in supporting relation beneath said fabric cover;

whereby said transom cylindrical connecting members have a dual utility in launching said boat and in contributing to the shaded comfort of the boat occupants during use thereof.

* * * * *